US005865493A

United States Patent [19]

Lee

[11] Patent Number: 5,865,493

[45] Date of Patent: Feb. 2, 1999

[54] ANCHORING DEVICE FOR USE WITH A HOISTING MACHINE

[76] Inventor: Kou-An Lee, No. 851, Chung-Shan Rd., Nan-Shing Tsun, Kui-Jen Hsiang, Tainan Hsien, Taiwan

[21] Appl. No.: 905,818

[22] Filed: Aug. 4, 1997

[30] Foreign Application Priority Data

Apr. 3, 1997 [TW] Taiwan ..... 86205224

[51] Int. Cl.[6] ..... B66C 1/54

[52] U.S. Cl. ..... 294/95; 294/110.2

[58] Field of Search ..... 294/93–95, 97, 294/110.1, 110.2, 115, 116, 67.31, 81.51, 81.61, 86.25, 906; 414/910, 911

[56] References Cited

U.S. PATENT DOCUMENTS

| | | | |
|---|---|---|---|
| 1,577,283 | 3/1926 | Mitchell . | |
| 1,615,115 | 1/1927 | Durhan, Jr. . | |
| 2,823,944 | 2/1958 | Anderson et al. . | |
| 3,046,046 | 7/1962 | Gris . | |
| 3,199,911 | 8/1965 | Alliot et al. | 294/95 |
| 3,231,303 | 1/1966 | Le Tourneau . | |
| 3,388,942 | 6/1968 | Johnsson et al. | 294/95 |
| 3,485,388 | 12/1969 | Bohne | 294/94 |
| 3,902,614 | 9/1975 | Roberts et al. . | |
| 4,253,695 | 3/1981 | Blaive et al. | 294/95 |
| 4,768,911 | 9/1988 | Balter . | |
| 5,071,184 | 12/1991 | Dessaux . | |
| 5,125,707 | 6/1992 | Chaen et al. . | |
| 5,762,815 | 6/1998 | Lee . | |

*Primary Examiner*—Dean Kramer
*Attorney, Agent, or Firm*—Baker & Botts, L.L.P.

[57] ABSTRACT

An anchoring device includes a hollow cylinder, a biasing unit, a shaft, a cam mechanism and a driven drum. The hollow cylinder has top and bottom ends, a cylindrical wall interconnecting the top and bottom ends, and a plurality of hook arms pivoted to the cylindrical wall. Each of the hook arms has a lower hook end which is extendible outward at the bottom end of the hollow cylinder to an operative position. The biasing unit retracts inward the lower hook ends. The shaft extends coaxially through the top end of the hollow cylinder and is movable axially relative to the hollow cylinder between a topmost position and a bottommost position. The cam mechanism is connected to the shaft. The driven drum is journalled on the shaft and has a lower end adjacent to the hook arms, and a plurality of circumferentially spaced and radially projecting push members formed on the lower end of the driven drum to push the hook arms outward against the biasing unit. The driven drum is rotatable with step-like movement by the cam mechanism upon axial movement of the shaft so as to index the push members relative to the hook arms.

10 Claims, 12 Drawing Sheets

ANCHORING DEVICE FOR USE WITH A HOISTING MACHINE

BACKGROUND OF THE INVENTION

1. Field of the Invention

This invention relates to an anchoring device, more particularly to an anchoring device for use with a hoisting machine.

2. Description of the Related Art

Conventionally, slings are used widely for attaching a load to a hoisting machine. For instance, four slings are required for attaching a hoist hook of a hoisting machine to a modular form assembly which is formed of four interconnecting form panels and which has a rectangular configuration. One end of each of the slings is connected to the hoist hook, while the other end of each of the slings is manually connected to and disconnected from an anchoring hook which is fixed on a respective one of the corners of the top of the modular form assembly during loading and unloading operations. Connection and disconnection of the slings and the anchoring hooks on the modular form assembly is very time-consuming and laborious.

SUMMARY OF THE INVENTION

It is therefore a main object of the present invention to provide an anchoring device which can be used for attaching a load to a hoisting machine in a time-saving and labor-saving manner.

According to the present invention, an anchoring device comprises a hollow cylinder, a biasing unit, a shaft, a cam mechanism and a driven drum. The hollow cylinder has top and bottom ends, a cylindrical wall interconnecting the top and bottom ends, and a plurality of hook arms pivoted to the cylindrical wall. Each of the hook arms has a lower hook end which is extendible outward at the bottom end of the hollow cylinder to an operative position. The biasing unit retracts inward the lower hook ends. The shaft extends coaxially through the top end of the hollow cylinder, and is movable axially relative to the hollow cylinder between a topmost position and a bottommost position. The cam mechanism is connected to the shaft. The driven drum is journalled on the shaft and has a lower end adjacent to the hook arms, and a plurality of circumferentially spaced and radially projecting push members formed on the lower end thereof to push the hook arms outward against the biasing unit. The driven drum is rotatable with step-like movement by the cam mechanism upon axial movement of the shaft so as to index the push members relative to the hook arms.

In the preferred embodiment, the push members are provided at regular intervals. The intervals are equal to a distance between two adjacent ones of the hook arms. The driven drum displaces a distance equal to half of the distance of the hook arms in each movement thereof.

The cam mechanism comprises a cam plate connected to the shaft, and a cam follower connected to the driven drum and operable by the cam plate. The cam plate has a connecting portion extending radially from the shaft, and an arcuate portion which is spaced radially from the shaft, which extends axially downward from the connecting portion and which is curved about the axis of the shaft. The arcuate portion has a cam groove formed therein and inclined with respect to an axial direction of the shaft.

Preferably, the anchoring device further comprises a driving drum connected to the driven drum and sleeved around the shaft. The cam follower is mounted to the driving drum and is received slidably in the cam groove. The driving drum is rotatable in a first direction when the shaft is moved downward from the topmost position to the bottommost position, and in a second direction that is opposite to the first direction when the shaft is moved upwardly from the bottommost position to the topmost position.

The driven drum is sleeved around the driving drum. The driving drum has a ratchet mechanism to prevent the driven drum from rotating when the driving drum is rotated in the first direction, thereby enabling the driven drum to rotate in a single direction along the second direction of the driving drum.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
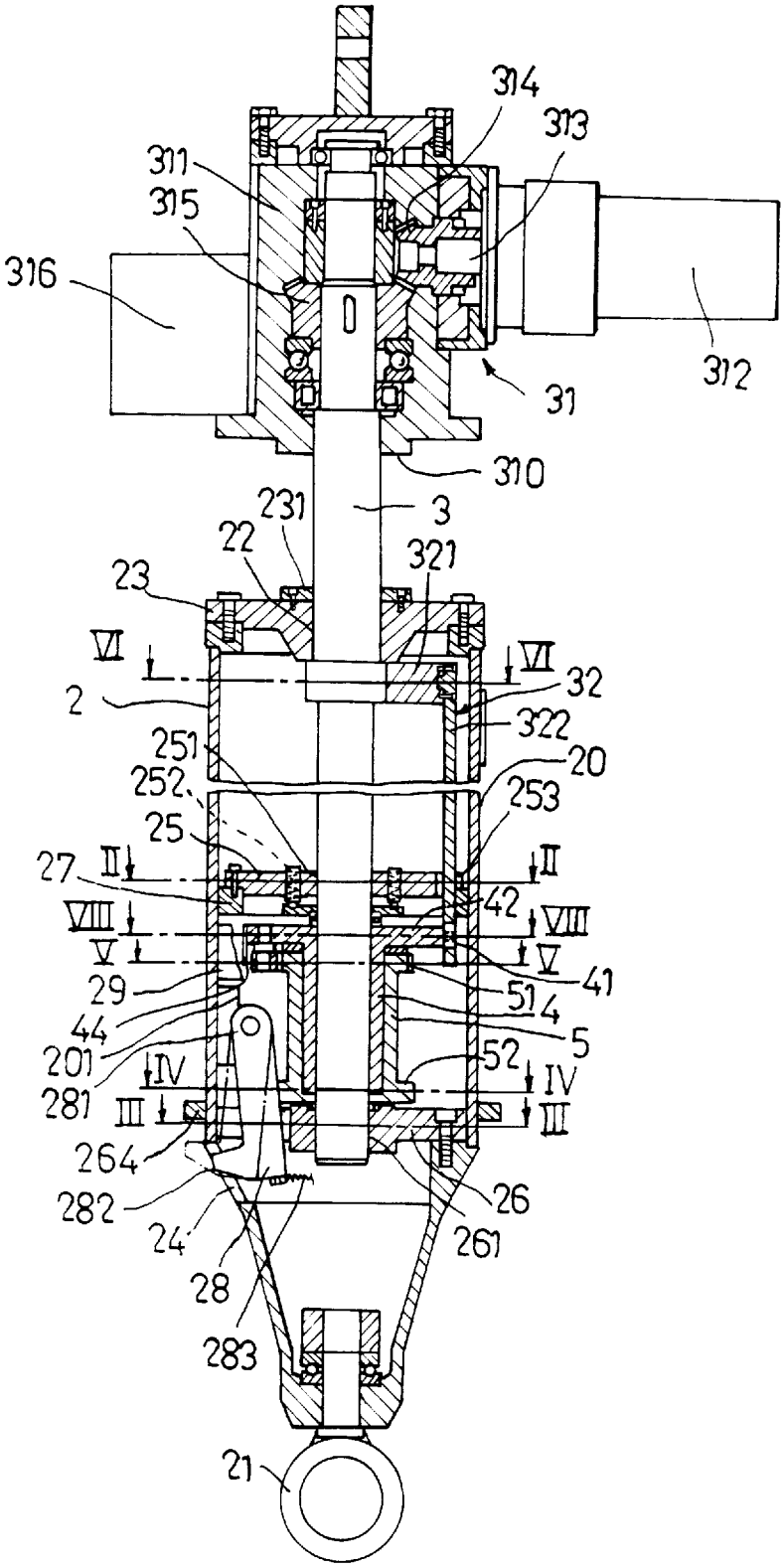
FIG. 1 is a sectional schematic view of a preferred embodiment of an anchoring device according to the present invention.

Referring to FIG. 1, a preferred embodiment of an anchoring device according to the present invention is shown to comprise a hollow cylinder 2 and a shaft 3. The hollow cylinder 2 has top and bottom ends, a cylindrical wall 20 interconnecting the top and bottom ends, and four hook arms 28 pivoted to the cylindrical wall 20. The top end of the cylinder 2 has a lid 23 fixed thereto in order to close the top end. The lid 23 has a central hole 22 formed therein and an annular pad 231 fixed on the top thereof. The bottom end of the cylinder 2 has hook ring 21 connected rotatably thereto. Four equally spaced slots 24 are formed annularly adjacent to the bottom end of the cylinder 2. An annular flange 264 extends outwardly from an external face of the cylindrical wall 20 right above the slots 24. Each of the hook arms 28 has an upper end 281 which is connected pivotally to a pivot seat 201 formed on the cylindrical wall 20 and a lower hook end 282 which is extendible outward via a respective one of the slots in the bottom end of the cylinder 2 to an operative position, which is described in more detail hereinbelow.

Figure 4:
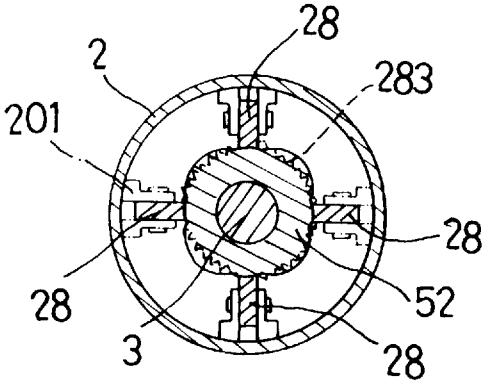
FIG. 4 is a cross sectional view taken along the line IV—IV in FIG. 1.

A biasing unit 283 is connected to the hook arms 28 for retracting inward the lower hook ends 282 within the cylinder 2. Preferably, the biasing unit 283 has four tension springs which interconnect the hook arms 28, as best illustrated in FIG. 4. A steering device 31 is mounted adjacent to the top end of the shaft 3 for driving the shaft 3 to rotate about its axis. The steering device 31 has a body portion 311 and a motor 312 mounted to the body portion 311. The output shaft 313 of the motor 312 has a bevel gear 314 which engages a bevel gear 315 that is formed on the shaft 3. A power supply means 316 is mounted to the body portion 311 of the steering device 31. The shaft 3 extends coaxially through the annular pad 231 and the central hole 22 of lid 23 on the top end of the cylinder 2, and is movable axially relative to the cylinder 2 between a topmost position and a bottommost position, as shown by the solid line and phantom line in FIG. 1, respectively.

Referring to FIGS. 1 and 4, a driven drum 5 is journalled on the shaft 3 and has an upper end, a lower end adjacent to the hook arms 28, and four circumferentially spaced and radially projecting push members 52 formed on the lower end thereof to push the hook arms 28 outward against the biasing unit 283. The driven drum 5 is rotatable with step-like movement by a cam mechanism which is connected to the shaft 3 upon axial movement of the shaft 3 so as to index the push members 52 relative to the hook arms 28, which is described in more detail hereinbelow.

The push members 52 are provided at regular intervals. The intervals are equal to a distance between two adjacent ones of the hook arms 28. The driven drum 5 displaces a distance equal to half of the distance of the hook arms 28 in each movement thereof.

Figure 7:
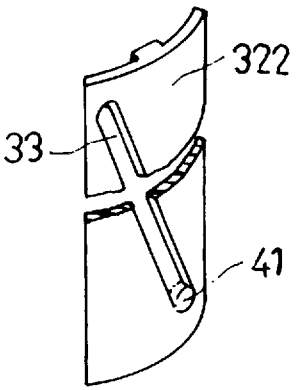
FIG. 7 is a perspective view of an arcuate portion of a cam plate of the anchoring device of the present invention.
Figure 6:
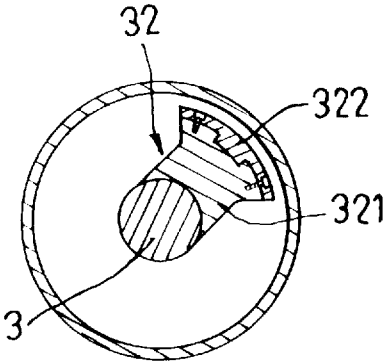
FIG. 6 is a cross sectional view taken along the line VI—VI in FIG. 1.

Referring to FIGS. 1 and 6, the cam mechanism comprises a cam plate 32 connected to the shaft 3, and a cam follower 41 connected to the driven drum 5 and operable by the cam plate 32. The cam plate 32 has a connecting portion 321 extending radially from the shaft 3, and an arcuate portion 322 which is spaced radially from the shaft 3, which extends axially downward from the connecting portion 321 and which is curved about the axis of the shaft 3. The arcuate portion 322 has a cam groove 33 formed therein and inclined with respect to an axial direction of the shaft 3, as best illustrated in FIGS. 7 and 8.

Referring again to FIG. 1, the anchoring device further comprises a driving drum 4 connected to the driven drum 5 and sleeved around the shaft 3 below the connecting portion 321 of the cam plate 32. The cam follower 41 is formed as a roller and is connected slidably to an arm member 42 which extends radially from an upper end of the driving drum 4, as best illustrated in FIG. 8. Therefore, the cam follower 41 is movable between upper and lower ends of the cam groove 33. The driving drum 4 is rotatable in a first direction when the shaft 3 is moved downward from the topmost position to the bottommost position, and in a second direction that is opposite to the first direction when the shaft 3 is moved upwardly from the bottommost position to the topmost position. It is noted that the connecting portion 321 of the cam plate 32 abuts against the lower face of the lid 23, and the cam follower 41 abuts against the upper end of the cam groove 33 when the shaft 3 is moved to the topmost position. On the other hand, the lower face 310 of the body portion 311 of the steering device 31 abuts against the pad 231 on the lid 23, and the cam follower 41 abuts against the lower end of the cam groove 33 when the shaft 3 is moved to the bottommost position.

Figure 5:
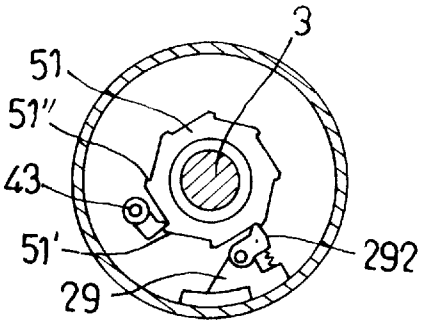
FIG. 5 is a cross sectional view taken along the line V—V in FIG. 1.

Referring to FIGS. 1 and 5, the driven drum 5 is sleeved around the driving drum 4. The driving drum 4 has a ratchet mechanism to prevent the driven drum 5 from rotating when the driving drum 4 is rotated in the first direction, thereby enabling the driven drum 5 to rotate in a single direction along the second direction of the driving drum 4. The ratchet mechanism includes eight teeth 51 formed on the upper end of the driven drum 5, and a spring-loaded detent pawl 292 which is fixed to a seat 29 on the cylindrical wall 20 of the cylinder 2 and which engages one of the teeth 51.

Figure 8:
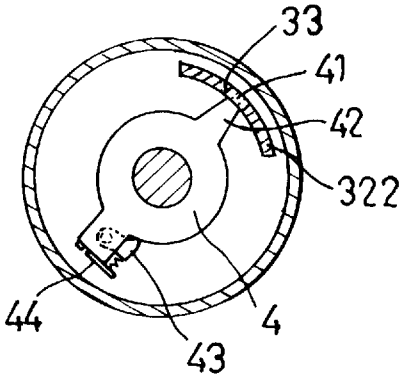
FIG. 8 is a cross sectional view taken along the line VIII—VIII in FIG. 1.

Referring to FIG. 8, a spring-loaded driving pawl 43 is connected pivotably to a seat member 44 which is formed on the upper end of the driving drum 4. The driving pawl 43 engages the other one of the teeth 51 to drive the driven drum 5 to rotate when the driving drum 4 is rotated in the second direction, and slides over the other one of the teeth 51 to engage an adjacent one of the teeth 51 when the driving drum 4 is rotated in the first direction.

Figure 3:
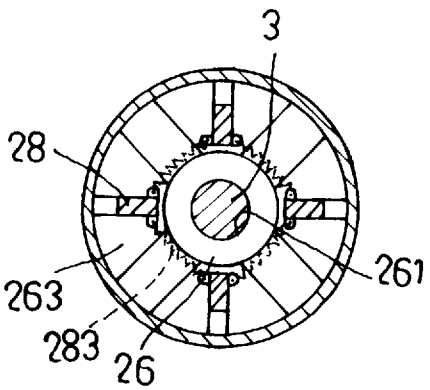
FIG. 3 is a cross sectional view taken along the line III—III in FIG. 1.
Figure 2:
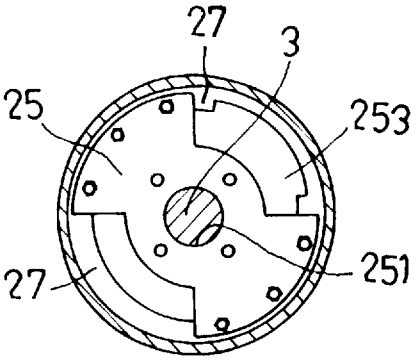
FIG. 2 is a cross sectional view taken along the line II—II in FIG. 1.

Referring to FIG. 1, a stop unit is provided in the cylinder 2 for preventing axial movement of the driving and driven drums 4 and 5 with respect to the cylinder 2. The stop unit includes upper and lower thrust members 25 and 26 which are fixed in the cylinder 2 respectively above and below the driving and driven drums 4 and 5. The periphery of the upper thrust member 25 is fixed to an inwardly extending flange 27 of the cylindrical wall 20. Each of the upper and lower thrust members 25, 26 has a central hole 251, 261 through which the shaft 3 passes. The upper thrust member 25 has a through hole 253 for passage of the arcuate portion 322 of the cam plate 32, as best illustrated in FIG. 2. The lower thrust member 26 has a plurality of through bores 263 for outward extension of the hook arms 28, as best illustrated in FIG. 3.

Figure 15:
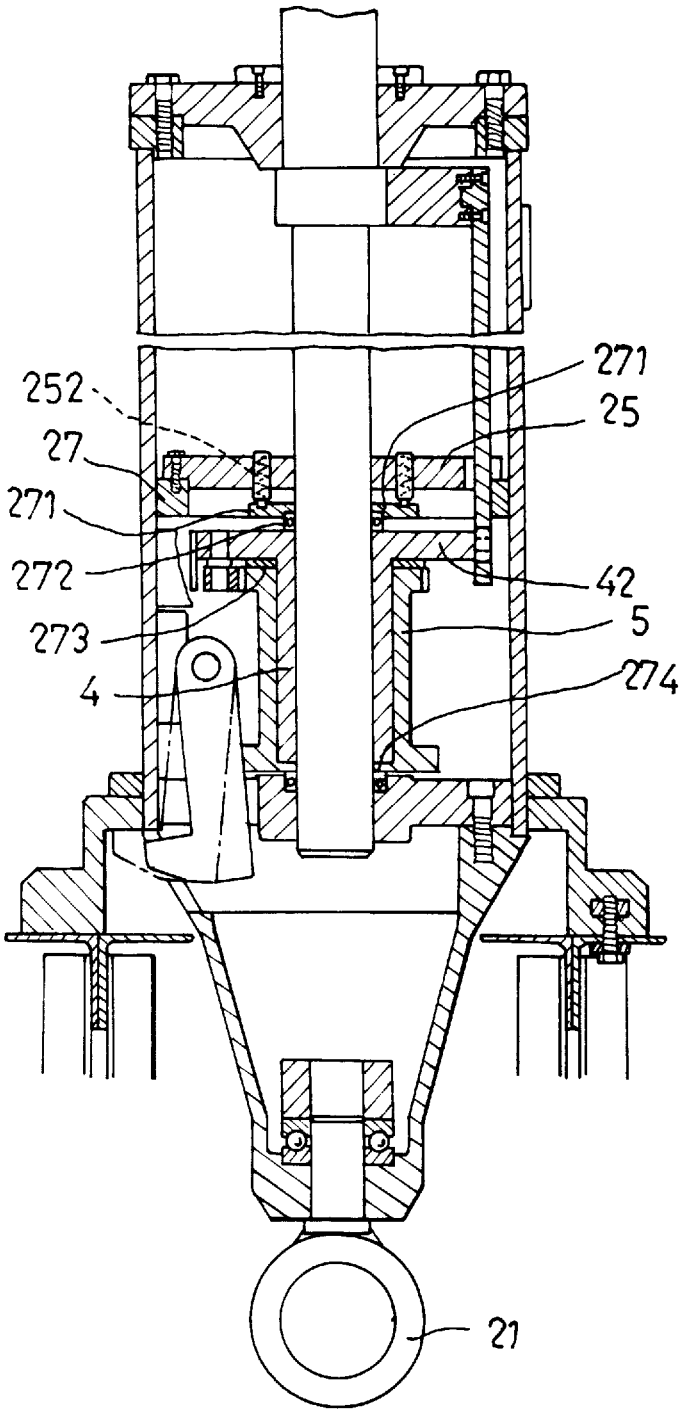
FIG. 15 is a sectional schematic view illustrating how driving and driven drums of the anchoring device of the preferred embodiment engage frictionally one another.

Referring to FIG. 15, a plurality of compression springs 252 are mounted between a lower face of the upper thrust member 25 and a press plate 271 which is disposed on a first thrust bearing 272 that is in turn disposed on the upper end of the driving drum 4. The shaft 3 passes through the press plate 271 and the first thrust member 272. A friction disk 273 is disposed between the upper ends of the driving and driven drums 4, 5. A second thrust bearing 274 is disposed between the lower end of the driven drum 5 and the lower thrust member 26. With such an arrangement, the compression springs 252 can urge the driving and driven drums 4, 5 to engage frictionally one another in order to prevent further rotation of the driven drum 5 due to the rotation inertia thereof after the driving drum 4 drives the driven drum 5 and stops rotating in the second direction.

Figure 9:
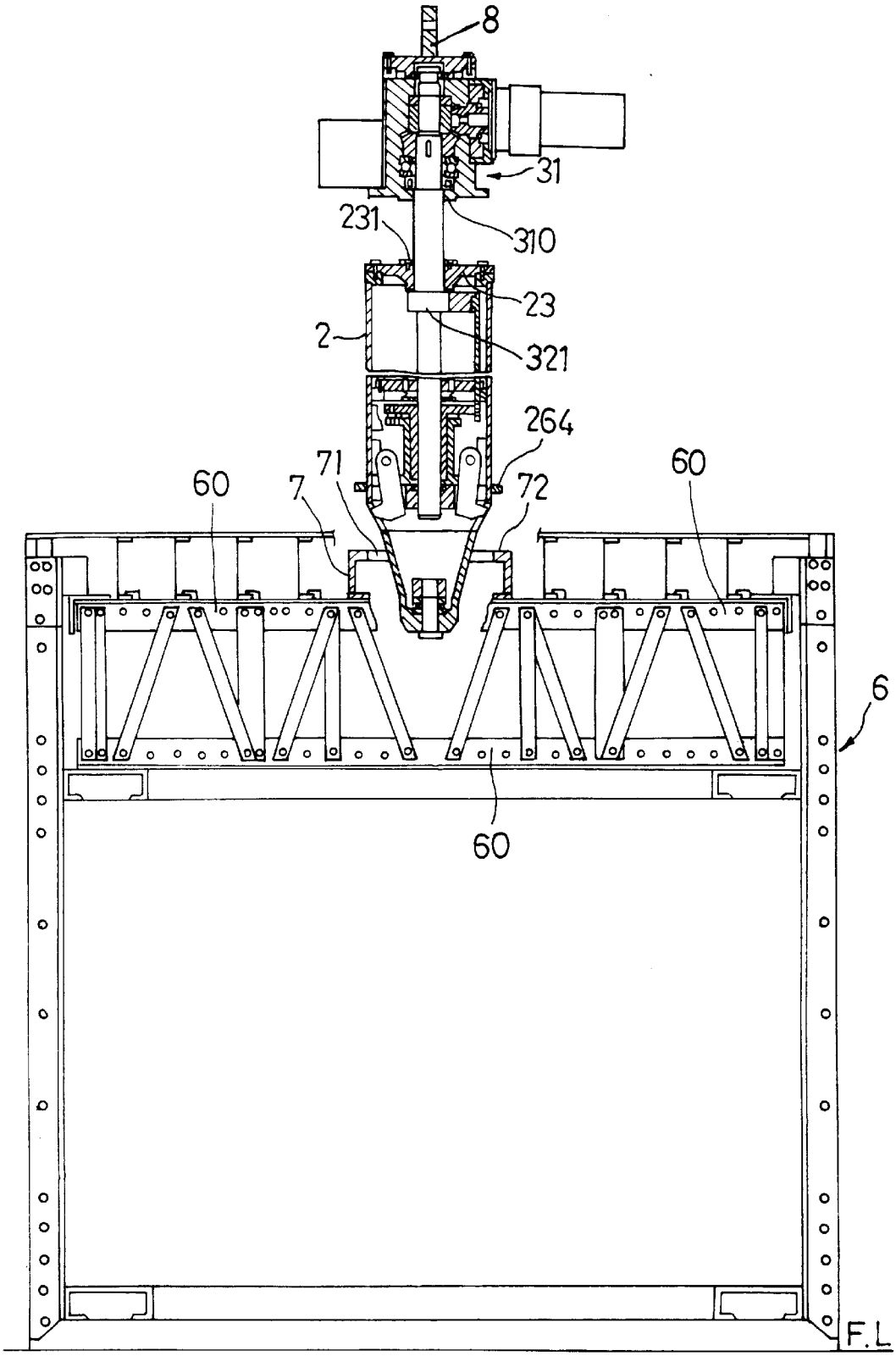
FIGS. 9 through 12 are sectional schematic views illustrating how the preferred embodiment of the anchoring device is used for attaching a rectangular modular assembly to a hoisting machine in a loading operation.
Figure 10:
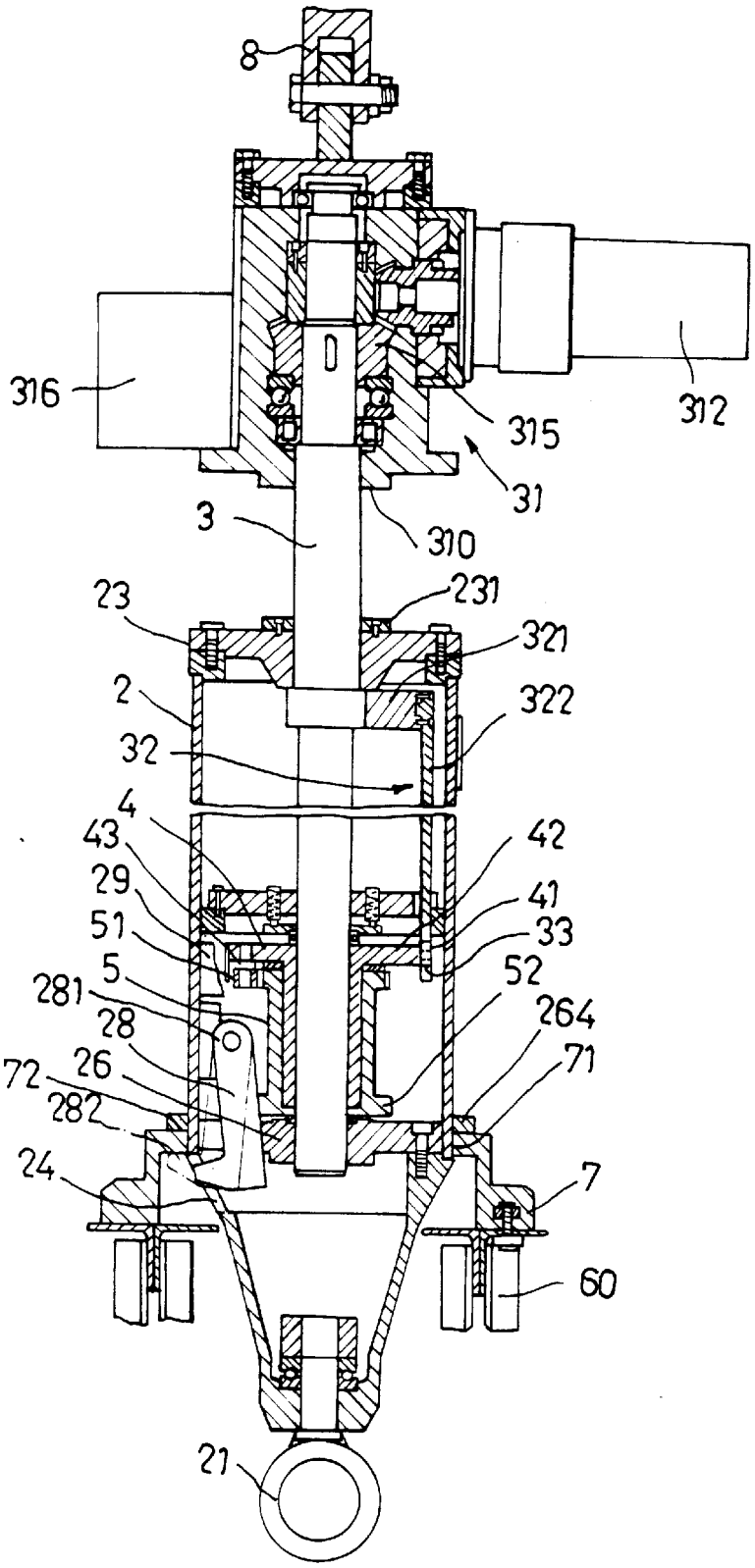
Figure 11:
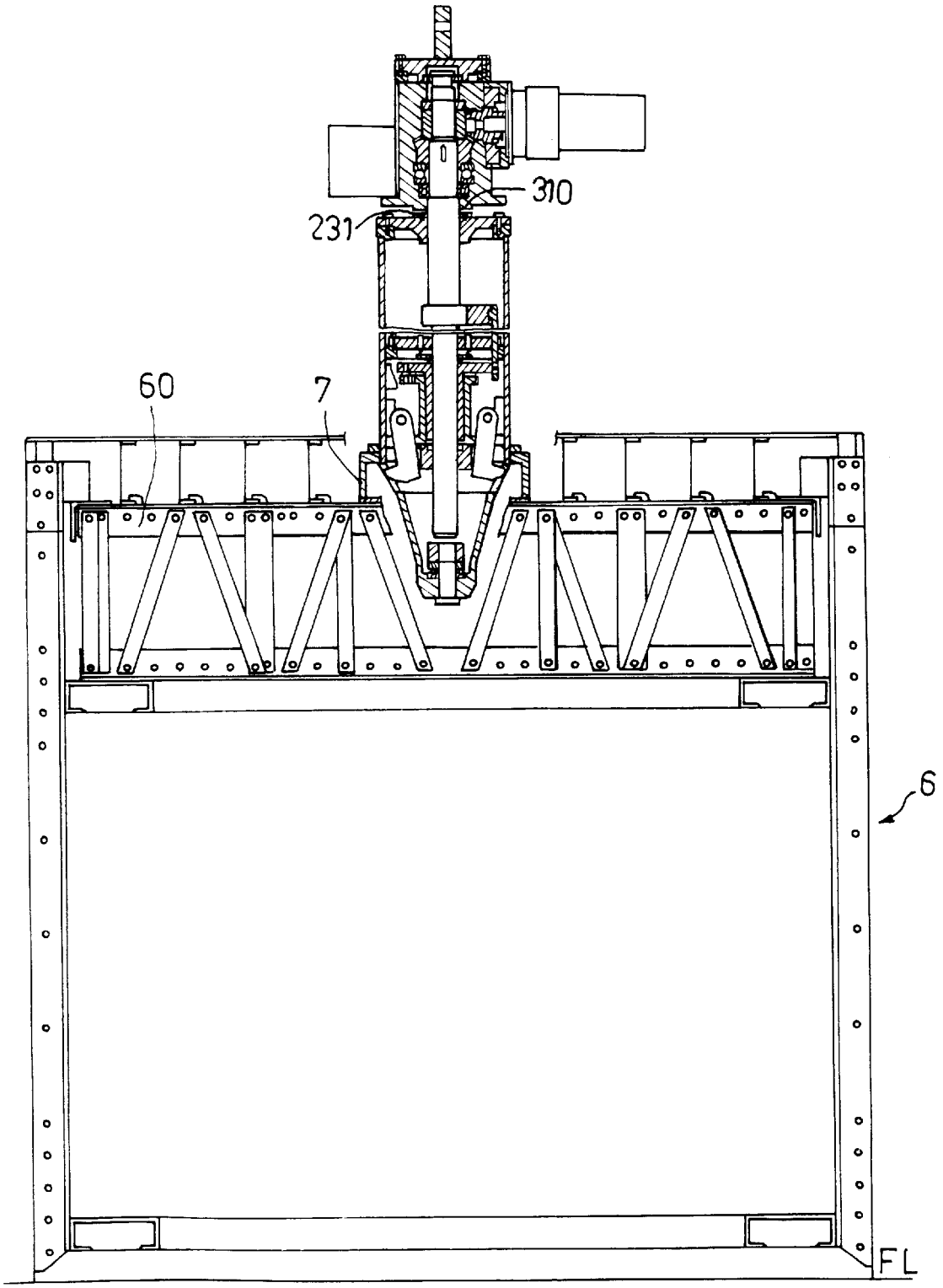

In use, with reference to FIGS. 9 and 10, the top end of the shaft 3 of the anchoring device is first connected to a hook member 8 of a hoisting machine. The shaft 3 is moved to the topmost position, i.e. the connecting portion 321 of the cam plate 32 abuts against lid 23. The anchoring device is moved right above a central hole 71 of an engaging seat 7 which is fixed centrally to two spaced trussed beams 60 that are in turn fixed to the top portion of a rectangular modular steel form assembly 60 to be hoisted. The anchoring device is then lowered to permit the annular flange 264 of the cylinder 2 to rest on the periphery of the central hole 71 of the engaging seat 7, as shown in FIG. 10. The cylindrical wall 20 is stopped by the engaging seat 7, and the shaft 3 and the cam plate 32 are moved downward relative to the cylindrical wall 20 until the lower face 310 of the steering device 31 abuts against the pad 231 on the lid 23. At this time, the cam follower 41 is moved from the lower end to the upper end of the cam groove 33, thereby resulting in rotation of the driving drum 4 in the first direction at an angle of about 45°. That is, as shown in FIG. 4, the driving drum 4 will rotate clockwise by about 45°. The driving pawl 43 will slide over one of the teeth 51' to engage an adjacent tooth 51", as best illustrated in FIG. 5. At this stage, the driven drum 5 is not driven to rotate due to the detent pawl 292 of the ratchet mechanism and therefore, the lower hook ends 282 of the hook arms 28 is located within the cylinder 2, as shown in FIGS. 10 and 11.

Figure 12:
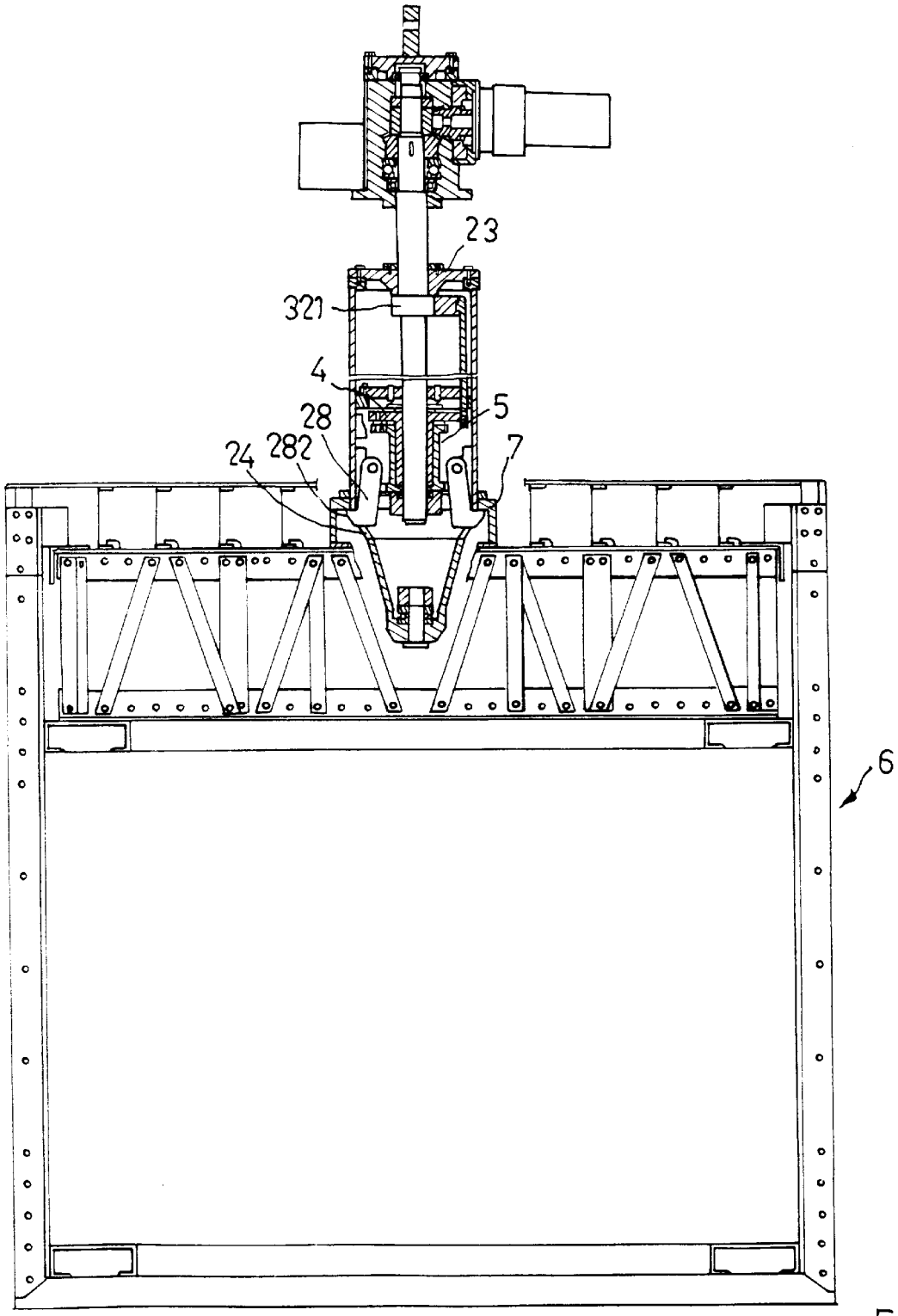

Subsequently, the shaft 3 of the anchoring device is raised by the hoisting machine until the connecting plate 321 abuts against the lid 23, as best illustrated in FIG. 12. The cam plate 32 is moved upward, and the cam follower 41 is moved from the upper end to the lower end of the cam groove 33. At the same time, the driving drum 4 rotates counterclockwise by about 45° to drive the driven drum 5 to rotate by the same angle. Therefore, the push members 52 can be aligned with the hook arms 28 and can push the lower hook ends 282 to extend outward of the cylinder 2 via the slots 24 to an operative position, as shown by the phantom lines in FIG. 1. The lower hook ends 282 thus engage the lower face of the engaging seat 7 adjacent to the central hole 71. When the shaft 3 is further raised by the hoisting machine, the modular form assembly 6 is raised with the use of the anchoring device.

Figure 13:
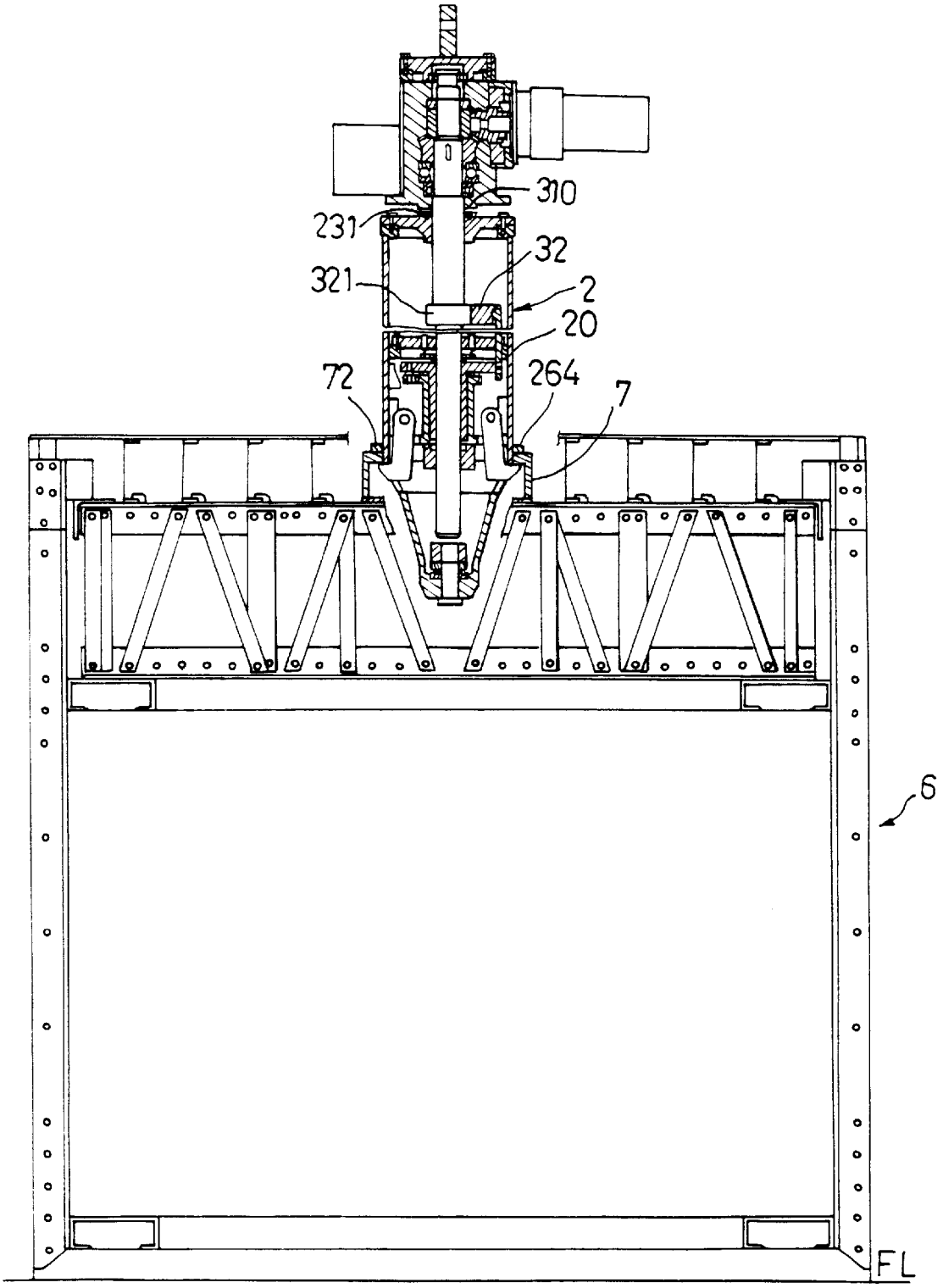
FIGS. 13 and 14 are sectional schematic views illustrating how the preferred embodiment of the anchoring device is used for detaching a rectangular modular assembly from a hoisting machine in an unloading operation.
Figure 14:
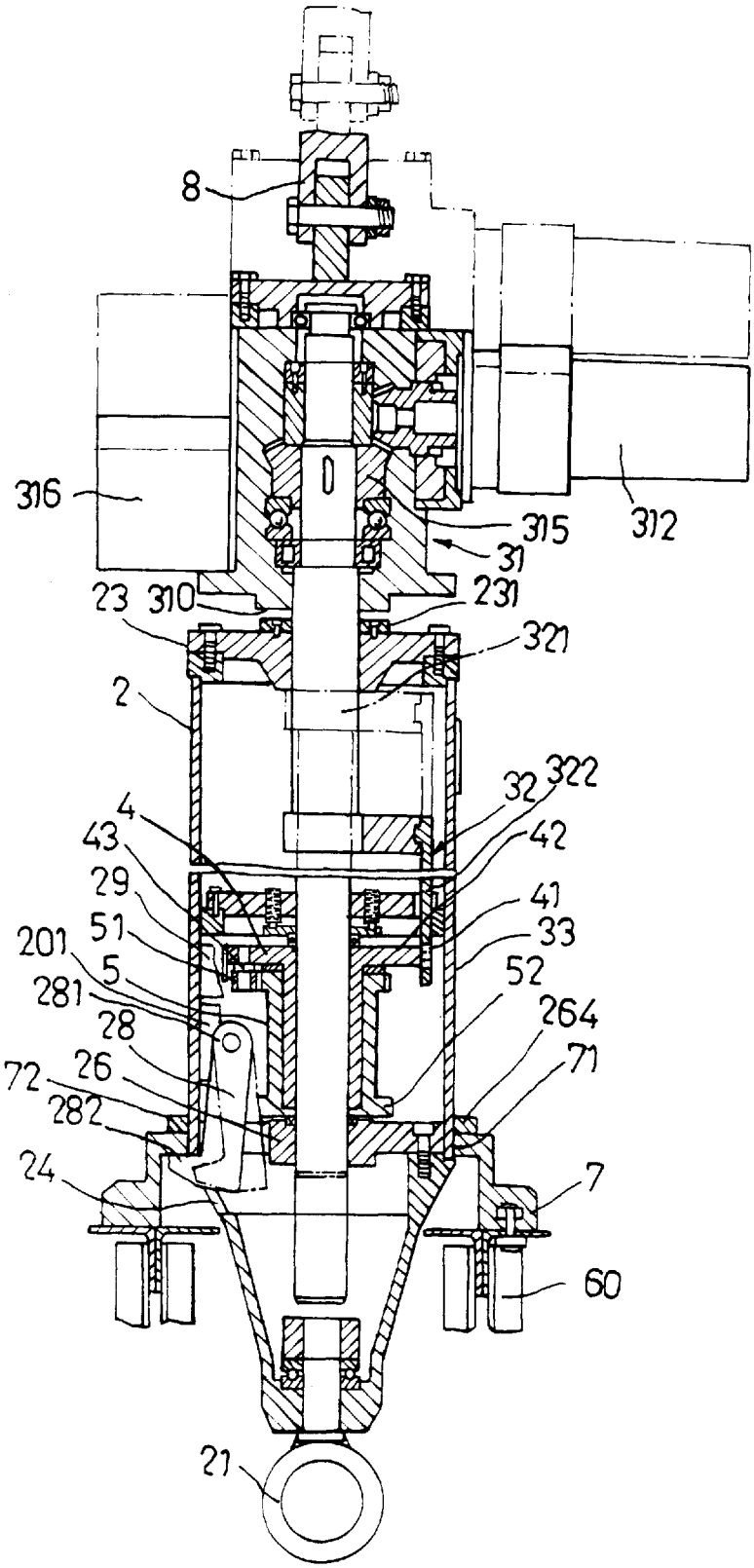

After the modular form assembly 6 is moved right above a predetermined location, it is lowered to the ground by the hoisting machine, as best illustrated in FIG. 13. At this time, the shaft 3 of the anchoring device begins to descend from its topmost position to its bottommost position in a manner as described hereinbefore. Since the driven drum 5 is not rotated as the driving drum 4 is rotated in the first direction, i.e. clockwise, the lower hook ends 282 of the hook arms 28 remain in the operative position, as shown by the solid line in FIG. 14. However, when the shaft 3 is raised from its bottommost position to its topmost position, the driven drum 5 is driven to rotate counterclockwise by about 45° by the driving drum 4 in a manner as described above, thereby disengaging the push members 52 from the hook arms 28 to permit the retraction of the lower hook ends 282 into the cylinder 2 via the slots 24, as shown by the phantom lines in FIG. 14. Thus, the anchoring device disengages the engaging seat 7 as the shaft 3 is further raised by the hoisting machine.

Therefore, the modular form assembly can be conveniently connected to and disconnected from the hoisting device with the use of the anchoring device of the present invention without the need for manual connection and disconnection operations as taught in the prior art.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. An anchoring device, comprising:

a hollow cylinder having top and bottom ends, a cylindrical wall interconnecting said top and bottom ends, and a plurality of hook arms pivoted to said cylindrical wall, each of said hook arms having a lower hook end which is extendible outward at said bottom end to an operative position;

a biasing unit for retracting inward said lower hook ends;

a shaft extending coaxially through said top end of said hollow cylinder and being movable axially relative to said hollow cylinder between a topmost position and a bottommost position;

a cam mechanism connected to said shaft; and a driven drum journalled on said shaft and having a lower end adjacent to said hook arms, and a plurality of circumferentially spaced and radially projecting push members formed on said lower end thereof to push said hook arms outward against said biasing unit, said driven drum being rotatable with step-like movement by said cam mechanism upon axial movement of said shaft so as to index said push members relative to said hook arms.

2. The anchoring device as claimed in claim 1, wherein said push members are provided at regular intervals, said intervals being equal to a distance between two adjacent ones of said hook arms, said driven drum displacing a distance equal to half of the distance of said hook arms in each movement thereof.

3. The anchoring device as claimed in claim 2, wherein said cam mechanism comprises a cam plate connected to said shaft, and a cam follower connected to said driven drum and operable by said cam plate.

4. The anchoring device as claimed in claim 3, wherein said cam plate has a connecting portion extending radially from said shaft, and an arcuate portion which is spaced radially from said shaft, which extends axially downward from said connecting portion and which is curved about the axis of said shaft, said arcuate portion having a cam groove formed therein and inclined with respect to an axial direction of said shaft.

5. The anchoring device as claimed in claim 4, further comprising a driving drum connected to said driven drum and sleeved around said shaft, said cam follower being mounted to said driving drum and being received slidably in said cam groove, said driving drum being rotatable in a first direction when said shaft is moved downward from said topmost position to said bottommost position, and in a second direction that is opposite to said first direction when said shaft is moved upwardly from said bottommost position to said topmost position.

6. The anchoring device as claimed in claim 5, wherein said driven drum is sleeved around said driving drum, said driving drum having a ratchet mechanism to prevent said driven drum from rotating when said driving drum is rotated in said first direction, thereby enabling said driven drum to rotate in a single direction along said second direction of said driving drum.

7. The anchoring device as claimed in claim 6, wherein said ratchet mechanism includes a plurality of a teeth formed on an upper end of said driven drum and a spring-loaded detent pawl which is fixed to said cylindrical wall of said hollow cylinder and which engages one of said teeth.

8. The anchoring device as claimed in claim 7, further comprising a spring-loaded driving pawl which is connected pivotably to an upper end of said driving drum, said driving pawl engaging the other one of said teeth to drive said driven drum when said driving drum is rotated in said second direction and sliding over the other one of said teeth to engage an adjacent one of said teeth when said driving drum is rotated in said first direction.

9. The anchoring device as claimed in claim 5, further comprising a stop unit for preventing axial movement of said driving and driven drums with respect to said hollow cylinder.

10. The anchoring device as claimed in claim 9, wherein said stop unit includes upper and lower thrust members which are fixed in said hollow cylinder respectively above and below said driving and driven drums, each of said upper and lower thrust members having a central hole through which said shaft passes, said upper thrust member having a through hole for passage of said arcuate portion of said cam plate, said lower thrust member having a plurality of through bores for outward extension of said hook arms.

* * * * *